US005219067A

United States Patent [19]

Lima et al.

[11] Patent Number: 5,219,067

[45] Date of Patent: Jun. 15, 1993

[54] KEYBOARD PAD STRUCTURE FOR ELECTRONIC DEVICES

[75] Inventors: David J. Lima, Los Altos; John G. Tang, San Carlos, both of Calif.

[73] Assignee: Trimble Navigation Limited, Sunnyvale, Calif.

[21] Appl. No.: 830,734

[22] Filed: Feb. 4, 1992

[51] Int. Cl.[5] ..... H01H 13/06

[52] U.S. Cl. ..... 200/302.2; 200/329; 200/345; 200/5 A

[58] Field of Search ..... 200/302.1, 302.2, 329, 200/333, 341, 345, 517, 5 R, 5 A, 81.5, 81.4, 83 B

[56] References Cited

U.S. PATENT DOCUMENTS

| | | | |
|---|---|---|---|
| 4,021,630 | 5/1977 | Taylor | 200/302.2 X |
| 4,078,257 | 3/1978 | Bagley | 200/517 X |
| 4,109,118 | 8/1978 | Kley | 200/517 X |
| 4,170,104 | 10/1979 | Yamagata | 200/302.2 X |
| 4,184,321 | 1/1980 | Tarusawa | 200/302.2 X |
| 4,580,018 | 4/1986 | Yoshihara | 200/517 X |
| 4,916,262 | 4/1990 | Jungels-Butler et al. | 200/517 X |
| 5,089,671 | 2/1992 | Ranetkins | 200/302.2 |
| 5,092,459 | 3/1992 | Uljanic et al. | 200/302.2 X |
| 5,107,083 | 4/1992 | Yagi | 200/341 |

FOREIGN PATENT DOCUMENTS

| | | | |
|---|---|---|---|
| 3142367 | 5/1983 | Fed. Rep. of Germany | 200/302.2 |
| 2382759 | 9/1978 | France | 200/302.2 |
| 313820 | 12/1989 | Japan | 200/302.2 |

*Primary Examiner*—Henry J. Recla
*Assistant Examiner*—Glenn T. Barrett
*Attorney, Agent, or Firm*—Thomas E. Schatzel

[57] ABSTRACT

An electronic housing structure including an enclosure for containing at least one electronic device having a plurality of user interface switches. The electronic housing structure further has a user interface pad attached to the enclosure near the user interface switches for operating said user interface switches. The user interface pad further seals the enclosure to completely seal and protect the electronic device. The enclosure and the user interface pad are composed of a waterproof, dust-proof and mud-proof material whereby said electronic device can be operated in an outdoor condition.

7 Claims, 1 Drawing Sheet

KEYBOARD PAD STRUCTURE FOR ELECTRONIC DEVICES

BACKGROUND OF THE INVENTION

1. Field of the Invention

This invention relates generally to a housing structure including a keyboard pad assembly for containing and operating an electronic device contained therein. More particularly, this invention relates to a housing structure including a keyboard pad assembly which is specifically designed and manufactured to protect the electronic device for operating in adverse environmental conditions, e.g., the dusty, moist and muddy conditions.

2. Description of the Prior Art

The performance of an electronic device is often very sensitive to environmental conditions in which the device is operated. Continuous and reliable outdoor operation of an electronic device is particularly limited by the concerns that the device may be subject to moist, muddy, dusty, and other types of potentially hazardous environmental conditions. This concern often limits the usefulness of certain types of electronic devices such as a portable global position system (GPS) receiver since it needs to receive signals from satellites while outdoors such that the satellites signals are not blocked by any type of obstructions. GPS receivers are often used by sailors while at sea, or by outdoorsman and soldiers in rural areas, and therefore may often be subject to adverse environmental conditions. Besides GPS receivers, with the widespread use of electronic use of electronic devices in society's daily activities, the demand for apparatuses and methods to overcome difficulties posed by operation in adverse environmental conditions are becoming more important.

Electronic apparatuses are becoming conveniently portable because of miniaturization of integrated circuits (ICs). As inexpensive microprocessors capable of handling highly complicated processes at very high speed are widely available, portable electronic apparatuses are being provided with user interfaces including keyboards, mouses, joysticks, optical scanners, notepads, voice synthesizers, etc. It is anticipated that the use of such portable electronic apparatuses will include many kinds of working environments such as in factories, grocery stores, warehouses, football fields, ships, airplanes, wilderness, and many other places under various environmental situations and conditions. For these types of applications, the user interfaces must be easily accessible, conveniently operable, and properly insulated from the potential environmental hazards so that their performance is not adversely affected.

A variety of small electrical switches are commonly used to operate apparatuses, but environmental inclosure, labeling, and actuation of the switches are normally accomplished by a keypad of some sort. Generally keypads are either separate, rigid parts or flexible membranes.

For outdoor operation, the portable GPS receivers currently available on the market require that users carefully handle the receivers to avoid potentially hazardous environmental conditions. Generally the most vulnerable part of the receivers is the user interface keys which provide mechanical contacts with electrical switches to operate the receivers. These keys must be exposed to provide easy close to the electrical switches to provide for the mechanical contact. The electric switches are therefore subject to exposure to various adverse operation conditions. With conventional keyboard structures, a malfunction of these switches or other parts of the GPS receivers is likely to occur once the GPS receivers are placed in a moist, dusty or muddy outdoor environment which may adversely effect the connection of the switches or the performance of other parts of the electronic circuits.

SUMMARY OF THE PRESENT INVENTION

It is therefore an object of the present invention to provide an electronic housing structure for containing and protecting an electronic device such that the electronic device can be operated in an adverse environment conditions such as dusty, muddy and moist conditions.

It is another object of this invention to provide an electronic housing structure including a keyboard pad assembly disposed on an external surface of the housing structure whereby the internal electronic device can be conveniently operated from external operation of the keyboard pad assembly.

It is a further object of the present invention to provide an electronic housing structure including a keyboard pad assembly which is tightly sealed to prevent moisture, mud or dust particles from entering into the chamber enclosed by the housing structure.

It is a further object of the present invention to provide an electronic housing structure including a keyboard pad assembly having a plurality of pliable key pads each including a sealing means to individually seal the housing structure and to interface about a corresponding electric switch disposed adjacent to the key pad.

It is a further object of the present invention to provide an electronic housing structure including a keyboard pad assembly having a plurality of pliable key pads with each key pad including a press-down cap and a striking stump such that by applying pressure to press-down caps the striking stumps press tightly against the adjacent user interface switches to activate the electrical switches.

It is a further object of the present invention to provide an electronic housing structure wherein there is an integration of enclosure including sealing, activation and labeling.

Briefly, in a preferred embodiment, the present invention comprises an electronic housing structure including an enclosure for containing at least one internal electronic device therein. The internal electronic device includes a plurality of user interface switches. The electronic housing structure has a user interface keyboard pad assembly attached to the enclosure near the user interface switches for individually operating the user interface switches responsive to user's finger commands. The user interface pad further seals the enclosure and completely seal and protect the electronic device. The enclosure and the user interface pad are composed of a waterproof, dust-proof and mud-proof material whereby said electonic device can be operated in an outdoor condition.

An advantage of the present invention is that it provides an electronic housing structure capable of protecting the electronic system contained therein to allow continuous operation in adverse environmental conditions such as dusty, muddy or moist conditions.

Another advantage of the present invention is that it provides an electronic housing structure including a keyboard pad assembly disposed on an external surface of the housing structure whereby the internal electronic device can be conveniently operated from external operation of the keyboard pad assembly.

Another advantage of the present invention is that it provides an electronic housing structure including a keyboard pad assembly which is tightly sealed to the housing structure to prevent moisture, mud or dust particles from entering into the chamber enclosed by the housing structure.

Another advantage of the present invention is that it provides an electronic housing structure including a keyboard pad assembly having a plurality of pliable key pads with each key pad including a sealing means individually seals the housing structure and interfaces with a corresponding electric switch disposed near the individual key pad.

Another advantage of the present invention is that it provides an electronic housing structure including a keyboard pad assembly having a plurality of pliable key pads with each key pad including a press-down cap and a striking stump such that by applying pressure to press-down caps the striking stumps press tightly onto the user interface switches to activate these switches.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1:
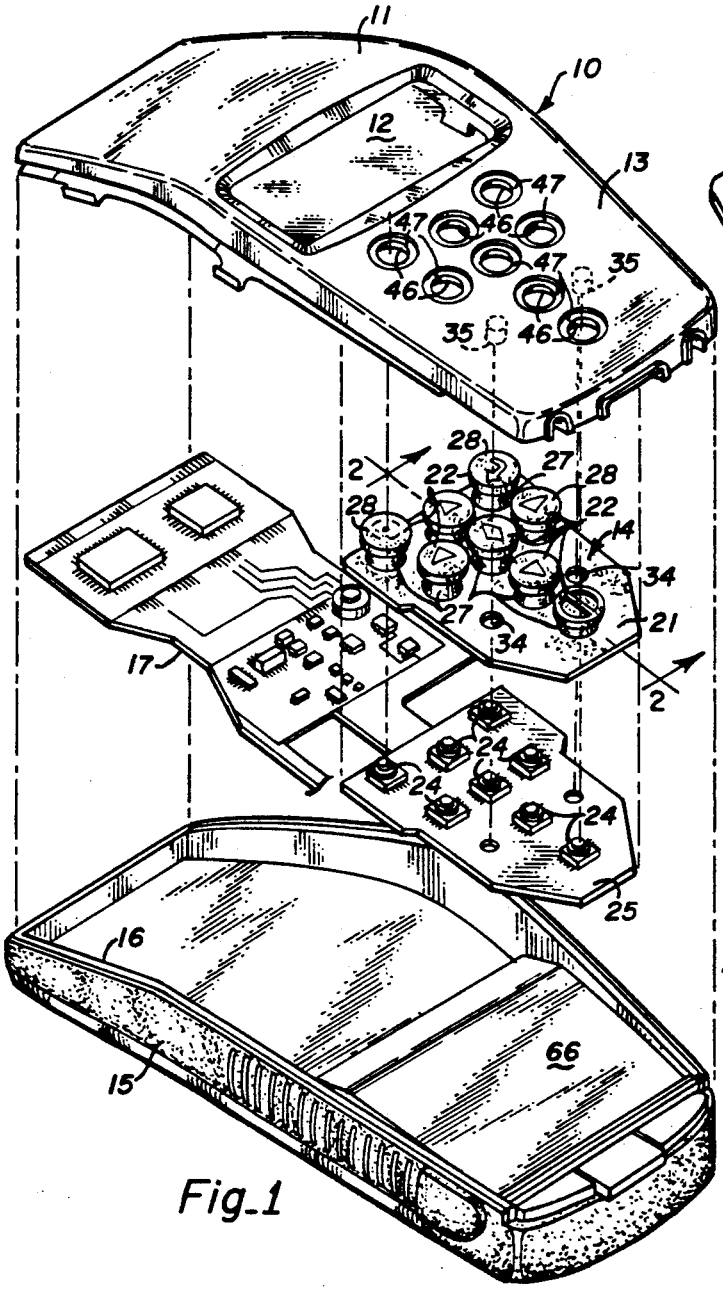
FIG. 1 is an exploded perspective view of an electronic housing structure including a keyboard pad assembly according to the present invention.
Figure 3:
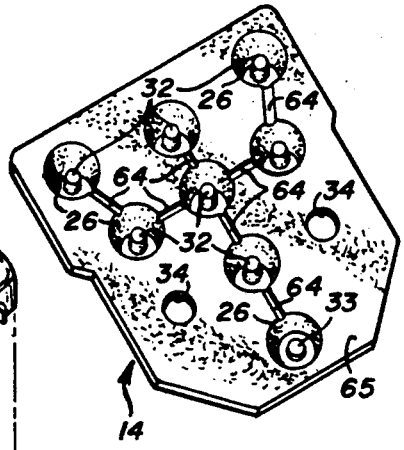
FIG. 3 is a perspective bottom view of the keyboard pad assembly of FIG. 1.

FIG. 1 is a perspective, exploded view of an electronic housing structure, for a hand-held GPS receiver, indicated by the general reference numeral 10. The housing structure 10 includes an upper shell section 11, a liquid crystal display (LCD) display window 12, a keyboard interface section 13 and a keyboard pad assembly 14 which includes a top, a PCB pad with switches and a back according to the present invention. The upper shell section 11 is sealed to a lower shell 15 about a peripheral edge 16. The keyboard pad assembly 14 is tightly attached to and seals to the upper shell 11 such that the upper shell 10, a lower shell 15, the display panel 12, and the keyboard pad assembly 14 completely enclose and protect an internal electronic device 17 contained therein. The keyboard pad assembly 14 is a molded integral rubber assembly with a planar base 21 with a plurality of circular elevated key pads 22 with each key pad 22 disposed in alignment with a corresponding user interface switch 24 of a multiple switch assembly 25.

Referring specifically to FIGS. 1 to 4, the housing structure 10, includes eight key pads 22 on the keyboard pad assembly 14 which corresponds to eight switches 24 on the switch assembly 25. The top surface of each key pad 22 can be formed with a different projection such that a user can conveniently differentiate between the various key pads 22 without requiring direct visual inspection. The keyboard pad assembly 14 includes seven key pads with convex top surface, and one key pad with a concave top surface. Each key pad 22 forms a conical interface chamber 26 by a conical wall 27 projecting from the base 21 and a cap surface 28 on top of the wall 27. Within each interface chamber 26 there is a striking stump 32 projecting internally from the cap surface 28 and coaxial with the chamber 26. Depending on the spacing between the switches 24 and the terminal end of the stumps 32, the length of the individual stumps 32 may be selected as illustrated by a stump 33. Selection of the length of the striking stumps 32 is designed to regulate the actuation force applied to the switches 24 which is functional dependent on the distance of vertical displacement of the striking stumps 32. Keyboard pad assembly 14 also includes two bores 34, one about each outside edge of the base 21. The bores 34 are included for fitting to two corresponding fixing stubs 35 disposed on the inside surface of the upper shell 11 to assure that the keyboard pad assembly 14 and the base 21 are securely and positively aligned with the upper shell 11.

Each of the cap surfaces 28 is substantially circular in shape with the outer edge extending slightly beyond the outer wall 27 and intersection of each cap surface 28 and its associated wall 27. Each key pad 22 protrudes through a corresponding switch interface opening 46 within the upper shell 11. The heights of the side wall 27 are substantially equal to the thickness of the upper shell 11 and a downward elastic force is generated because the flange seal 44 about the edge of the opening 46 has a natural height which is lower than that of the corresponding side wall 44 and thus intersects the top surface of the upper cell 11. Also, the outer wall 27 is conical so that it is compressed somewhat when installed within an associated interface opening 46. Thus, when assembled, the interaction of the periphery of the cap surface 28 and the shell 11 generates a downward elastic force as a result of the tension in the wall surrounding the wall 27 which in turn causes the flange seal to press down tightly onto the upper surface of the upper shell 11. A first seal is thus formed at the point where the base 21 of the keyboard pad assembly 14 intersects the bottom surface of the upper cell 11. Furthermore, each opening 46 is formed with a lip 47 to receive the sealing flange 44 and associated key pad 22. Thus, a second seal is established about the interface opening 46 thereby preventing moisture, dust, mud or other foreign particles from entering into the enclosed space through the openings 46.

Referring to FIG. 1, the user interface switches 24 are associated with the enclosed electronic device 17. Generally switches 60 are on/off toggle type of switches. Thus the user can conduct predefined functions by pressing down one or more of the cap surfaces 28 according to a predefined program. For convenience of operation, the switches 24 are placed in a predesignated area away from the main body of the electronic device 17 to avoid any possible inadvertent interference with the functioning of the electronic device 17. The user interface switches 24 are individually positioned to correspond with the pattern of key pads 22 such that the fingers of the device operator can be conveniently positioned to push the key pads 22 aligned with the switches 24. The switches 24 are also placed relative to the liquid crystal display window 13 such that the user can simultaneously view the display while operating the switches 24 through the key pads 22.

Figure 4:
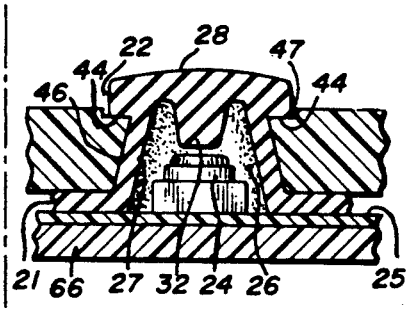
FIG. 4 is an enlarged, cross-sectional view of an assembled individual switch interfaced with an individual key pad disposed on the keyboard pad assembly of FIG. 1.
Figure 2:
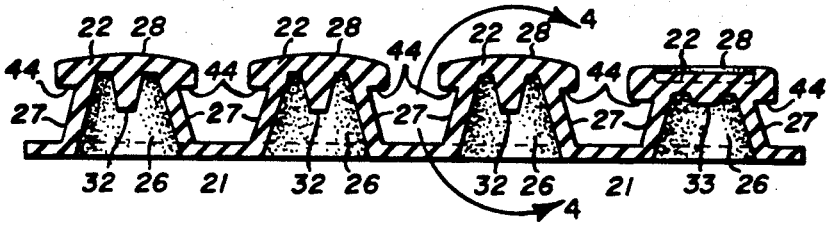
FIG. 2 is a cross-sectional view of the keyboard pad assembly along the line 2—2 in FIG. 1.

FIG. 4 further shows that the switches 24 are formed to have an upwardly dome shape with a size and height to fit within the interface chamber 26. The top of each switch 24 is maintained at a controlled distance near the lower end of the striking stump 32. Thus, an electronic device operator can easily operate the switches 24 by applying a finger pressure on the selective cap surfaces 28 to urge the striking stumps 32 to press against the switches 24. Furthermore, since the walls 27 of the key pads 22 are thin and easily deformable in response to the finger pressure applied to the cap surfaces 28 by a device operator, the seals formed between the upper cell 11 and the keyboard pad assembly are maintained during the operation of the key pads 22.

To further enhance the press-down operation of the key pads 22, a plurality of air passages 64 are provided. The passages 64 are approximately 0.05 inch in width and 0.020 inch in height. The air passages 64 are disposed about an inner surface 65 of the keyboard pad assembly 14 to provide air communication among the various interface chambers 26 whereby as any of the press-down cap surface 28 is pressed, the air in the interface chamber 26 is pressured to flow through the air passages 64 to other interface chambers 26 Thus, the switches 24 can be easily operated without being resisted by an internal air pressure caused by the air occupied in the interface chamber 26. Therefore, each key pad 22 enables the operation of the associated electric switches 24, and also individually seals each switch opening 46 to protect the enclosed electronic device 17 within the housing 10.

In the preferred embodiment the keyboard pad assembly 14 is composed of silicone rubber, durometer shore ranging from A-40 to A-90. The keyboard pad assembly 14 is thus pliable and provides waterproof, dust-proof, and mud-proof protection and also serves as a user interface for operating the enclosed electronic device. One example of a preferred embodiment according to the present invention, the keyboard pad assembly 14 is about 2.36 inches in length and about 2.09 inches in width. The key pads 22 are substantially circular in shape having diameters ranging from about 0.2 to 0.5 inches and the heights range from 0.25 to 0.35 inches, while the flange seals have heights ranging from about 0.18 to 0.22 inches. The length of the striking stumps 32 ranges from 0.05 to 0.16 inches to maintain an uniform height for all the striking stumps 32 at about 0.139 inches above the electric switches 24. A uniform distance between the user interface switches 24 and the lower end of the striking stumps 32 of approximately 0.75 inches is maintained by varying the length of the striking stumps 32. Therefore, an electronic device user may apply constant pressure to each key pad 22 to turn on and off each user interface switch 24 even though the key pads 22 may have different heights and/or sizes and shapes.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

We claim:

1. An electronic housing structure comprising:

an enclosure for containing at least one electronic device therein, said electronic device including a plurality of user interface switches;

a keyboard pad assembly including a plurality of key pads, each of said key pads corresponds to be adjacent to one of said corresponding user interface switches, said key pads are of different sizes and shapes whereby an electronic device user can conveniently differentiate each of said key pads without requiring a visual inspection;

the enclosure and the keyboards being comprised of a waterproof, dust-proof, and mud-proof material whereby said electronic device is more suitable for continuous outdoor operation;

each of said key pads includes an external surface, an internal surface opposite said external surface, an interface chamber and a convex press-down cap disposed on said external surface with a striking stump disposed on said internal surface opposite said press-down cap, said striking stump is adjacent to said corresponding user interface switch whereby a user can activate said corresponding user interface switch by applying pressure to said press-down cap urging said striking stump to contact said user interface switch;

said keyboard further includes an external surface, an internal surface opposite said external surface, and a plurality of air passages disposed on said internal surface of said keyboard, each of said air passages interconnecting with at least two of said interface chambers to maintain an air communication between said interface chambers of said key pads whereby said press-down keys may be easily pressed down without a need to overcome an air pressure resistance due to a volume of air in said interface chamber;

the enclosure further includes a plurality of user interface openings, each corresponding to one of said key pads, each of said key pads further has a sealing means whereby when said key pads are inserted in said corresponding user interface openings said key pads securely attach to the enclosure and tightly seals said user interface openings preventing moisture, dust, or mud from entering through said interface openings;

said sealing means of said key pad includes a sealing flange extending outwardly and downwardly from a lower edge of said press-down cap; and said corresponding interface openings on the enclosure include a step-down lip extending inwardly toward a center of said interface opening for receiving said flange seal of said key pad.

2. An electronic housing structure comprising:

an enclosure for containing at least one electronic device therein, said electronic device including a plurality of user interface switches;

a user interface key pad assembly attached to the enclosure near said user interface switches for operating said user interface switches, the user interface key pad assembly being a pliable keyboard including a plurality of key pads each of said key pads forming an interface chamber corresponding and being disposed adjacent to one of said corresponding user interface switches such that said corresponding switch is operationally responsive to a pressure applying to said key pads;

said keyboard including an external surface, an internal surface opposite said external surface, and a plurality of air passages disposed on said internal surface of said keyboard, each of said air passages interconnecting with at least two of said interface chambers to maintain an air communication between said interface chambers of said key pads whereby said press-down keys may be easily pressed down without a need to overcome an air pressure resistance due to a volume of air in said interface chamber.

3. The electronic housing structure of claim 2 wherein:

the enclosure and the user interface key pad assembly are composed of a waterproof, dust-proof, and mud-proof material whereby said electronic device is more suitable for continuous outdoor operation.

4. The electronic housing structure of claim 2 wherein:

each of said key pads of the keyboard assembly includes an external surface, an internal surface opposite said external surface, an interface chamber and a convex press-down cap disposed on said external surface and a striking stump disposed on said internal surface opposite said press-down cap, said striking stump being positional adjacent to said corresponding user interface switch whereby said corresponding user interface switch whereby said corresponding user interface switch can be activated by applying pressure to said press-down cap and urging said striking stump to contact said user interface switch.

5. The electronic housing structure of claim 2 wherein:

said key pads are of different sizes and shapes whereby an electronic device user can conveniently differentiate each of said key pads without requiring a visual inspection.

6. The electronic housing structure of claim 2 wherein:

the enclosure further includes a plurality of user interface openings, each corresponding to one of said key pads, each of said key pads further has a sealing means whereby when said key pads are inserted in said corresponding user interface openings said key pads are securely attached to the enclosure and tightly seals said user interface openings to prevent moisture, dust or mud from entering through said interface openings.

7. The electronic housing structure of claim 6 wherein:

said sealing means of said key pad include a flange seal extending outwardly and downwardly from a lower edge of said pressdown cap; and said corresponding interface openings on the enclosure include a step-down lip extending inwardly toward a center of said interface opening for receiving said flange seal of said key pad.

* * * * *